US005648623A

United States Patent [19]

Silverstein et al.

[11] Patent Number: 5,648,623

[45] Date of Patent: Jul. 15, 1997

[54] LIGATURE FOR WOODWIND INSTRUMENTS

[76] Inventors: Steven Silverstein, 307 Call Hollow Rd., Stony Point, N.Y. 10980; Michael J. Heinrich, 611 N. Midland Ave., Upper Nyack, N.Y. 10960

[21] Appl. No.: 543,171

[22] Filed: Oct. 13, 1995

[51] Int. Cl.[6] ..... G10D 9/02

[52] U.S. Cl. ..... 84/383 R

[58] Field of Search ..... 84/383 R, 383 A

[56] References Cited

U.S. PATENT DOCUMENTS

| | | | |
|---|---|---|---|
| 1,789,639 | 2/1931 | Selmer | 84/383 R |
| 4,056,997 | 11/1977 | Rovner | 84/383 R |
| 4,185,535 | 1/1980 | Lorenzini | 84/383 R |
| 4,258,604 | 3/1981 | Giokas | 84/383 R |
| 4,347,776 | 9/1982 | Grass et al. | 84/383 R |
| 4,428,271 | 1/1984 | Winslow | 84/383 R |
| 5,289,752 | 3/1994 | Barbaglia | 84/383 R |

*Primary Examiner*—Cassandra C. Spyrou
*Attorney, Agent, or Firm*—Angelo N. Chaclas

[57] ABSTRACT

A ligature for affixing a reed to the mouthpiece of a woodwind instrument, primarily saxophones and clarinets. A spiral of non-stretching cord, with a mechanism for defining the spiral's shape and for providing a way of tightening it, extends around the reed and the mouthpiece. The mechanism is suspended and tightened by a vertical bridge and an integral puller assembly. The spiral cord passes through holes in the puller. The puller is raised by way of a tightening nut through a non-resonant bridge all of which tightens the spiral cord to firmly hold the reed to the mouthpiece. The bridge bears down against the mouthpiece which applies force to the bridge's contact points. The tension of each wrap of the spiral is equalized by the forces upon the bridge and the puller's design. The spiral cord is damped from extraneous vibration by use of spacing combs and by way of this self equalizing design.

18 Claims, 3 Drawing Sheets

LIGATURE FOR WOODWIND INSTRUMENTS

BACKGROUND OF THE INVENTION

Ligatures have been de facto contrivances for securing clarinet and saxophone reeds throughout this century. Two hundred years ago, when the clarinet evolved from the chalumeau, woven cord was used as a ligature on a reed instruments.

The specialized separate reeds and mouthpiece of the modern clarinet and saxophone must ideally be mated flat surface to flat surface as if they were made of one piece. Such one piece systems occurred in bagpipe and chalumeaux reeds before the arrival of the clarinet and saxophone. In such one piece systems, no ligature was necessary because the reed and mouthpiece were one piece with no flat surfaces needing to be mated under pressure. However, modern convention based upon consistency dictates using separate reeds and mouthpieces. Generally, the same mouthpiece with a particular facing curve (distance from tip of reed) will last for years while the reeds warp and wear out in days or weeks.

Because reeds warp, the flat surface is rarely flat at each side where it is designed to be in permanent contact with the mouthpiece. A buzzy, unclear tone and chirping noise commonly occurs as a result, even amount seasoned professionals. The radial strength of the reed is such that only a drastic change in humidity on the bark can effect a counter measure to warpage. The amount of pressure necessary to flatten a reed to a mouthpiece could ruin the mouthpiece and crack the reed.

Prior art claims fall short in substantive solutions to the above problems. For example, U.S. Pat. No. 266,384, issued to Pascucci, suggests that reed pressure bars overcome warpage and reed life is extended in this design. However, this has been demonstrated to be inconclusive at best. It is widely established that reed life is affected not by these products but by enzymes in saliva as well as natural flex, fatigue and tongue contact breaking down cells. Less playing music is the only sure way to preserve a reed.

Prior art attempts at modernizing the original string ligature have often neglected the most important features and benefits of the simple original. The string of the nineteenth century was not elastic like nylons et. al. of today. Cotton or linen could be tied around the mouthpiece as tightly or loosely as desired without elasticity interfering with the interface between reed and mouthpiece. Those cords are more acoustically neutral, less susceptible to spurious vibration or over-dampening than much of today's stretchable materials. That is why such later designed ligatures can only be more convenient, not better acoustically.

Metal banded ligatures, such as those described in U.S. Pat. No. 1,789,639, issued to Selmer, are well known. Generally, they have weak brass thumb screws which strip their threads and deform the sheet metal to reed contact. Buzzing and squeaks are caused.

Pre-woven spiral or elastomeric O-ring ligatures, such as those described in U.S. Pat. No. 4,347,776, issued to Grass et. al., slip over the mouthpiece. But, not nearly enough pressure could be exerted to stabilize the reed's position. Further, the pressure is not adjustable at a given ring placement; a major problem.

Similar problems occur in cord sandwiched within rubber straps ligatures, such as described in U.S. Pat. No. 4,056,997, issued to Rovner. This design uses one screw across the two brackets so that when the top or bottom circumference of rubber stretches out as indeed occurs, there is no compensation for control over tightening those edges as much as the more central areas over the reed.

The ligature described in U.S. Pat. No. 4,428,271, issued to Winslow, uses soft rubber spacers which are difficult to torque. These are held by undamped C-clips, which further exacerbates the problem of spurious vibration.

The ligature described in U.S. Pat. No. 4,258,604, issued to Goikas, uses nylon strings held tight by plastic pieces and a screw at each end. In such a design the relative tightness of each string winding cannot be equalized or adjusted. The durability of the adjustment screws and continually stretching nylon cord are also questionable.

The ligature described in U.S. Pat. No. 4,185,535, issued to Lorenzini, uses several individual strings held by metal brackets and two thumbscrews which force the brackets closer together. Reeds are not ruler flat. This design does not account for natural variation in reed dimensions or provide means to equalize string pressure in response to that variation. If the particular circumference under one string is not in perfect linear proportion to the next one (a common occurrence), the string and reed could buzz, flex and destabilize the overall playing quality. Lorenzini's grooved brackets sandwiched between the string and mouthpiece cover one half of the circumference of the mouthpiece. This provides less support than the completely circular metal band designs. However, both designs are susceptible to buzzing and neither conform to the shape of, nor provide equal pressure around, the mouthpiece.

Therefore, there is a need for a ligature which substantially reduces spurious vibrations, is easy to use and durable.

SUMMARY OF THE INVENTION

It is an object of the present invention to present a ligature for woodwind instruments that substantially overcomes the disadvantages and problems associated with the prior art.

In accomplishing this and other objectives, there is provided a ligature for securing a reed to a mouthpiece of a woodwind instrument, comprising: a bridge having a hole and including a surface in bearing engagement with the mouthpiece; a spiral cord having a plurality of wraps, the spiral cord disposed axially along the mouthpiece with the reed therebetween, the bridge located angularly around the mouthpiece opposite to the reed; a puller having a plurality of holes, the wraps of the spiral cord passing through respective holes in the puller, the puller including an extension passing through the hole in the bridge; means for bearing against the bridge and lifting the puller away from the mouthpiece so that the spiral cord secures the reed to the mouthpiece Additional objects and advantages of the invention will be set forth in the description which follows, and in part will be obvious to those skilled in the art from the description, or may be learned by practice of the invention.

BRIEF DESCRIPTION OF THE DRAWINGS

The accompanying drawings, which are incorporated in and constitute a pad of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
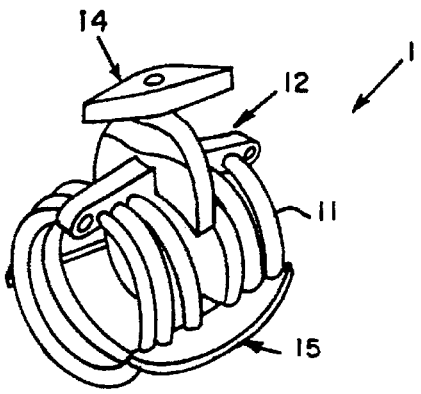
FIG. 1 is a perspective view of a ligature in accordance with the invention.

Referring to FIG. 1, an overall perspective view of a ligature 1 in accordance with the invention is shown. The ligature 1 is assembled, but not installed, on a woodwind mouthpiece (not shown).

Figure 2:
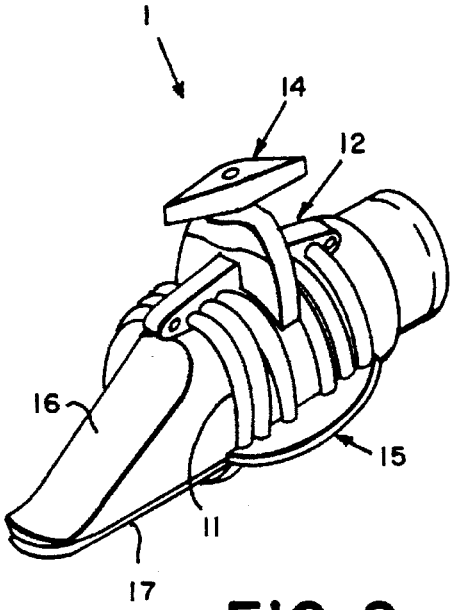
FIG. 2 is a perspective view of the ligature mounted on a typical mouthpiece with a reed in accordance with the invention.

Referring to FIG. 2, an overall perspective view of the ligature 1 assembled and installed on a typical woodwind mouthpiece 16, with a reed 17 in place on underside face of the mouthpiece 16 is shown.

Figure 3:
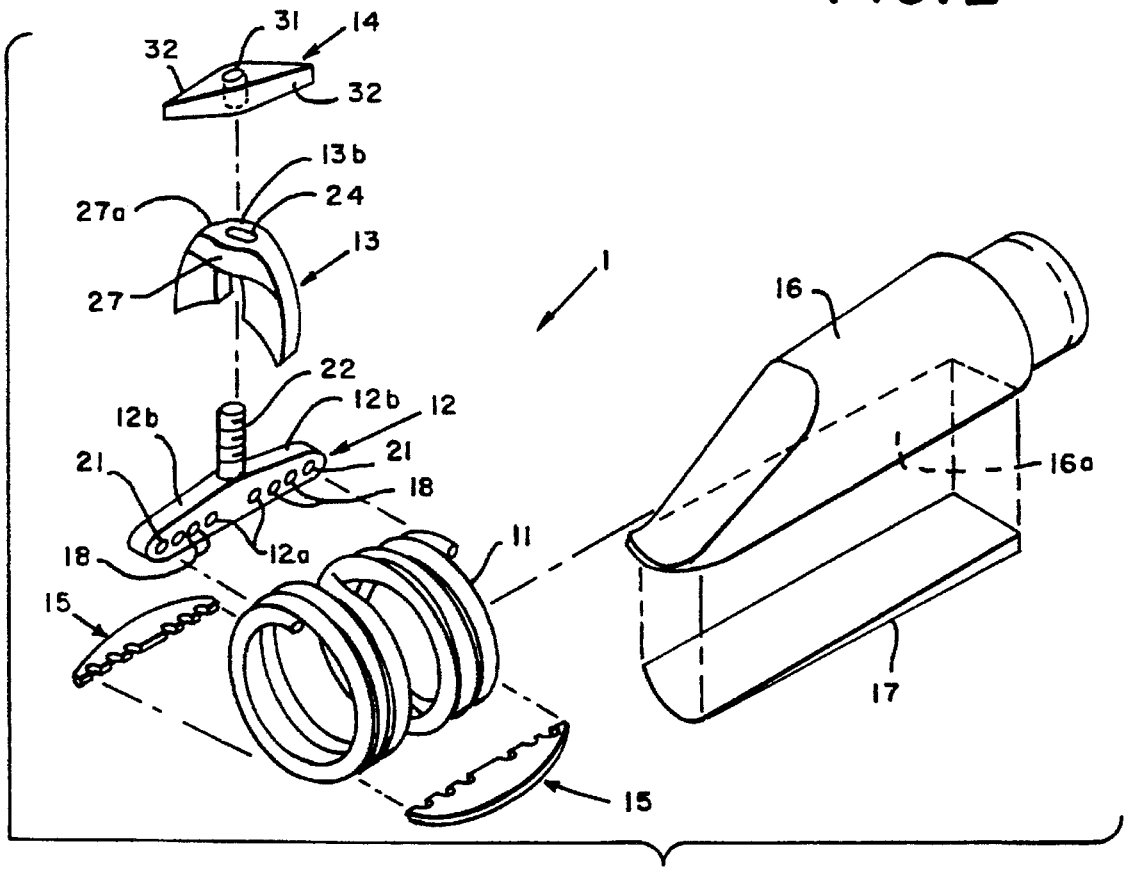
FIG. 3 is an exploded perspective view of the ligature, the mouthpiece and the reed in accordance with the invention.

Referring to FIG. 3, an exploded perspective view of the ligature 1 in relation to the typical woodwind mouthpiece 16 and the reed 17 is shown. The various parts of the ligature 1 are oriented in exploded relationship to each other. The ligature 1 includes a cord 11 which is held in a counter-rotating spiral configuration by a rigid alloy puller 12 and a pair of alloy combs 15. The cord 11, the puller 12 and the combs 15 form an assembly which slips over the mouthpiece 16 and the reed 17, securing the reed 17 to the face 16*a* of the mouthpiece 16. The assembly is drawn up and away from the mouthpiece 16 at the puller 12 by means of tightening the perpendicular threaded shaft 22 of the puller 12 through a clearance hole 24 in the bridge 13 which straddles the arms 12*b* of the puller 12 and rests on the mouthpiece 16. The puller shaft 22 is tightened by turning a nut 14 bearing on the body 13*b* of the bridge 13.

Figure 4A:
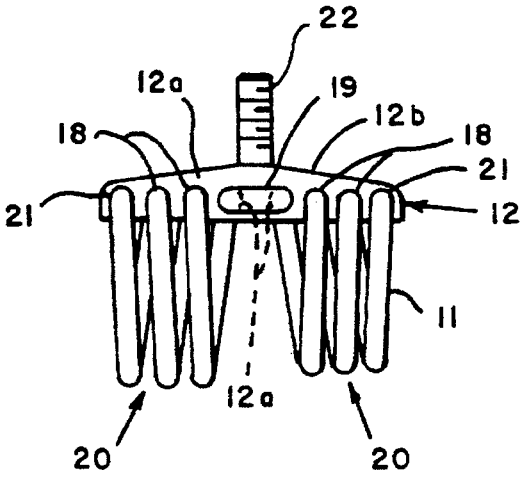
FIG. 4A is a side elevational view of a cord and a puller in accordance with the invention.
Figure 4B:
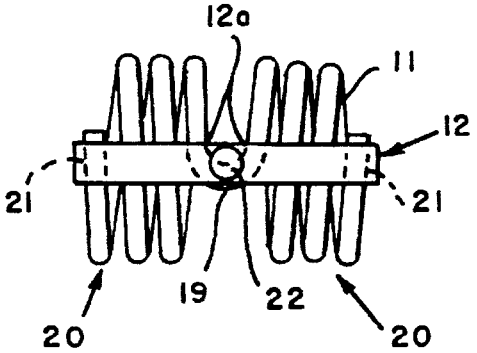
FIG. 4B is a plan view of the cord and the puller in accordance with the invention.
Figure 4C:
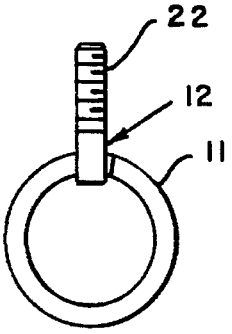
FIG. 4C is a front elevational view of the cord and the puller, taken along the axis of the cord, in accordance with the invention.

Referring to FIGS. 4A, 4B and 4C, the cord 11 and the puller 12 are shown in more detail. Referring to FIGS. 3, 4A, 4B and 4C, a central bend 19 in the cord 11 passes through two central holes 12*a* in puller 12 and winds several times around and through clearance holes 18. Each end of cord 11 forms a spiral loop 20. The loops 20 are in counter-rotating directions to each other, terminating at respective outermost holes 21 and heat-fused thereto to secure their positions. A perpendicular threaded post 22 on puller 12 engages nut 14 passing through bridge 13. Thus, each wrap of the cord 11 passes through its own loosely fitting hole 18 on the puller 12 as a means to allow slippage and equalize the tension between each wrap heterostatically.

Figure 5A:
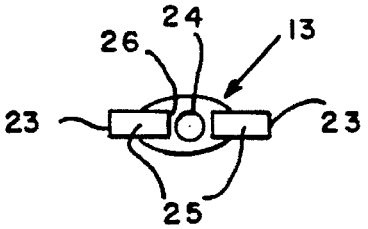
FIG. 5A is a bottom view of a first bridge in accordance with the invention.
Figure 5B:
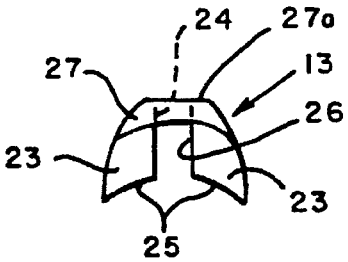
FIG. 5B is a front elevational view of the first bridge, taken along the same line of sight as FIG. 4C, in accordance with the invention.
Figure 5C:
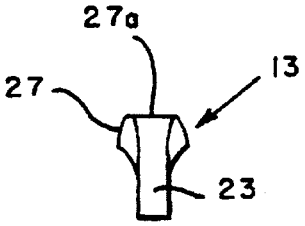
FIG. 5C is a side elevational view of the first bridge in accordance with the invention.
Figure 6A:
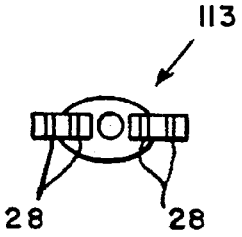
FIG. 6A is a bottom view of a second bridge in accordance with the invention.
Figure 6B:
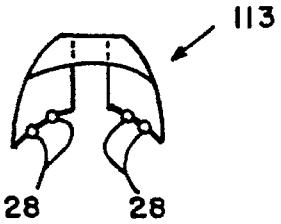
FIG. 6B is a front elevational view of the second bridge, taken along the same line of sight as FIG. 4C, in accordance with the invention.
Figure 6C:
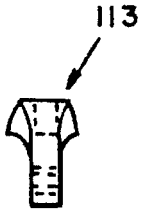
FIG. 6C is a side elevational view of the second bridge in accordance with the invention.
Figure 6D:
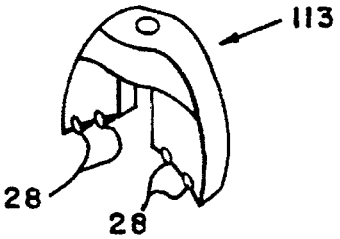
FIG. 6D is a perspective view of the second bridge in accordance with the invention.

Referring to FIGS. 5A, 5B and 5C, the bridge 13 is shown in more detail. Referring to FIGS. 3, 5A, 5B and 5C, the bridge 13 includes a pair of legs 23 which straddle the puller 12 and slip between the central wraps of the cord 11, to rest by means of respective feet 25 on top of the mouthpiece 16. A hole 24 in the bridge 13 provides means of clearance for threaded post 22 of puller 12. Bridge body 27 widens above the legs 23 to provide strength and a bearing surface 27*a* for the nut 14. The feet 25 have etched surfaces conforming to the contour the top of the mouthpiece 16. The etched surfaces may be achieved by high voltage Electronic Discharge Machining, etching or coarse grit abrasive. The purpose of the etching is to provide a grip on the mouthpiece 16 made of yielding material such as hard rubber or plastic. A height adjustment slot 26 provides for upward movement of the puller 12 for tightening adjustment. The bridge 13 may be made of any suitable high strength alloy or polymer, such as titanium, aircraft aluminum, stainless steel, ketone esters or phenolics.

Referring to FIGS. 6A, 6B, 6C and 6D, an alternative bridge 113 is shown. The bridge 113 includes special hard rubber or phenolic foot inserts 28 to provide traction on a mouthpiece 16 made from non-yielding material, such as metal or crystal. The foot inserts 28 act as a means to protect and isolate metal mouthpieces from the surfaces of the original roughened foot contacts.

Figure 7A:
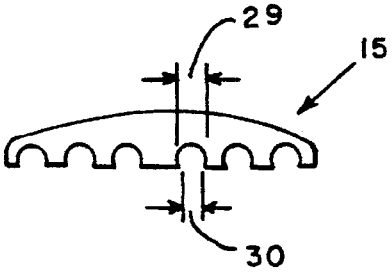
FIG. 7A is a front elevational view of a comb in accordance with the invention.
Figure 7B:
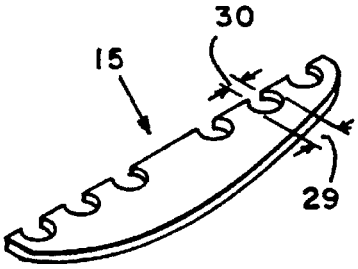
FIG. 7B is a perspective view of the comb in accordance with the invention.

Referring to FIGS. 7A and 7B, more detailed views of the comb 15 are shown. Referring to FIGS. 2, 7A and 7B, the cord 11 wraps are held in proper spacing and orientation by means of insertion through snap gap 30 into clearance diameter 29. The combs 15 snap over the spiral cord wraps as a means for controlling their spacing and keeping each wrap perpendicular to the axis of the reed 17.

Figure 8A:
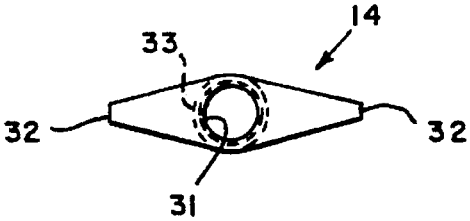
FIG. 8A is a bottom view of a nut in accordance with the invention.
Figure 8B:
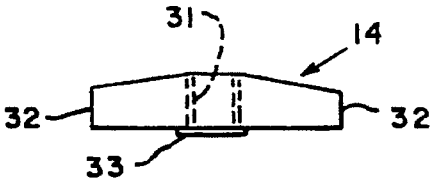
FIG. 8B is a side elevational view of the nut in accordance with the invention.

Referring to FIGS. 8A and 8B, the nut 14 is shown in more detail. Referring to FIGS. 2, 3, 8A and 8B, the threaded hole 31 of the nut 14 engages perpendicular threaded post 22 on the puller 12. Means of exerting tightening pressure in cord 11 through puller 12 passing through hole 24 in bridge 13, is provided for in a raised-boss bearing surface 33. Tightening of the nut 14 is accomplished by rotating wings 32 with fingers.

With the basic structure of the invention described as above, the application of the invention to a particular woodwind instrument will now be described.

The following dimensions apply to pertinent aspects of each component part of the invention, for purposes of scale reference. The dimensions described here are for a B-flat clarinet. Other size instruments may require proportional changes in these dimensions.

The cord 11 is typically between 58 and 100 cm in length depending upon application to size of instrument. For example the B-flat clarinet requires roughly 68–70 cm length.

The puller 12 height measured from under the holes to top of the perpendicular threaded post 22 is roughly 16 mm. The puller's thickness is approximately 5 mm. The puller's holes 18 are approximately 2.3 mm in diameter with the exception of the outermost hole at each end measuring 2.0 mm. The thread specification is ANSI #10–32 class 1. Other sizes may also be deemed appropriate. The puller 12 measures 26 mm in length overall.

The bridge 13 measures roughly 12.6 mm in height. Thickness of legs is 9 mm. Height adjustment slot 26 is 7.5 mm. The bridge special foot inserts 28 measure 1.85 mm in diameter.

The combs 15 are 27.5 mm long overall, 4.3 mm high overall, and 1.2 mm thick.

The nut 14 is approximately 22.6 mm long overall, 4.5 mm high, and 7 mm wide a center, with a #10–32 tapped hole.

With the basic structure of the invention described as above, the operational characteristics will now be described with reference to FIGS. 2 and 3. Slipping the assembly over the mouthpiece 16 and the reed 17 secures the reed 17 loosely in position on the face 16*a* of the mouthpiece 16. Each wrap of cord 11 is maintained in its place by the puller 12 through-holes 18 and by combs 15. Tightening the cord 11 pulls the wraps against the reed 17 and fixes it in an optimum secure position against the face 16*a* of the mouthpiece 16. Nut 14 is turned in a tightening rotation which as it bears against the stationary top 27*a* of the bridge 13 raises the puller 12 up and way from the mouthpiece 16. The puller 12, carrying the wraps of cord 11 tightens the wraps against the opposite side 16*a* of the mouthpiece 16 and the reed 17. Turning the nut 14 in a loosening rotation releases tension in the assembly and on the mouthpiece 16 and the reed 17, allowing removal or adjustment of the reed 17. It should not be apparent that the ligature 1 operates as a damped and balanced system, which avoids attachment plates, or their screws or clips, in proximity to the reed 17.

The present design takes the original string idea to a different level by using coated Kevlar® or other micro filament, such as that manufactured by Yale Cordage as coated Kevlar® (a Dupont® polymer) or Allied Signal's Spectra® with over ten times the tensile strength of previously used cord. Extraneous vibration within any pressure latitude is eliminated. Purity, and dynamic response are redefined. Additionally, the cord 11 provides a means to wick moisture to the bark of the reed 17 thereby lessening reed warpage. Those skilled in the art will recognize further advances. It will be apparent to those skilled in the art that the instant design utilizes new materials and configures components to accomplish uncompromised vibration. It also does its job affixing the reed to the mouthpiece, with unprecedented effectiveness. First, the instant design incorporates the most basic wound-string concept of reed-holding. However it utilizes an ideal non-stretching, non-yielding cord that both negates extraneous "sympathetic" vibration and avoids damping vibration generated by the reed and mouthpiece. Second, this spiral cord is held in a mechanism that maintains the cords spiral shape for convenient use and allows adjustment and tightness of the entire assembly through it, to an extent not attainable with simple winding, or any other prior art.

The mechanism is configured to isolate its components from areas where they would otherwise interact acoustically with the reed and mouthpiece, resulting in a ligature 1 that secures the reed 17 with an ordered self-equalizing or heterostatic pressure.

The use of a strong yet flexible material to provide holding power over the reed 17 to its mouthpiece 16, has distinct advantages over metal band types such as taught in U.S. Pat. No. 2,200,054, issued to Bundy, which can too easily deform rather than conform heterostatically. The metal band ligature must be shaped precisely to the contours of both mouthpiece and reed to keep from creating single-point pressure areas and voids where the ligature lifts clear of the surface. The result is uneven pressure distribution and potential rattling or other unwanted vibrations. The instant design utilizes a material that allows even pressure over any contour of mouthpiece or reed. Furthermore, it shows an advantage over prior art such as Rovner '997, where the woven cloth in a rubbery matrix allows for flexure and damping of vibration of the mouthpiece and reed. Because the instant design features a spiral coil made of untwisted Kevlar® clad in Dacrone®, it results in a very hard non-stretching cord minimizing vibration between the mouthpiece 16 and the reed 17.

Up to the present, the problem of extraneous vibration cause by weak rubbery surfaced ligatures, sheet metal, various soft brass screws, clips and the like, had not been adequately addressed. The present invention, inspired by new usage of advanced materials, embodies extensive engineering and musical insight to create a rigid, and vastly more durable solution to problems never before considered seriously. In terms of tone purity, dynamic range and articulation response, the absorptions and spurious additions to sound created by prior art have been virtually eliminated.

The objectives have substantially been met in providing a device that has been transformed from an accessory holding clamp to a ligature that solves some of the most overlooked problems in woodwind musical instruments. It neither adds nor takes away from the pure sound of the instrument or performer. The effect is dramatic. Confidence building is obvious. This invention is consistently reliable for years in a field filled with devises that can warp, stretch out, and strip their threads of soft metals and polymers.

The above descriptions and specifications fully stated herein should not be construed as limitations on the inventions scope but rather as one embodiment.

What is claimed is:

1. A ligature for securing a reed to a mouthpiece of a woodwind instrument, comprising:

a bridge having a hole and including a surface in bearing engagement with the mouthpiece;

a spiral cord having a plurality of wraps, the spiral cord disposed axially along the mouthpiece with the reed therebetween, the bridge located angularly around the mouthpiece opposite to the reed;

a puller having a plurality of holes, the wraps of the spiral cord passing through the holes in the puller, respectively, the puller including an extension passing through the hole in the bridge;

means operatively connected to the extension of the puller for bearing against the bridge and lifting the puller away from the mouthpiece so that the spiral cord secures the reed to the mouthpiece.

2. The ligature of claim 1, wherein:

the spiral cord includes a first end fixably attached to the puller and a second end fixably attached to the puller; and the wraps of the spiral cord are free to move within the holes of the puller so that, as the reed is secured to the mouthpiece, the tension in the wraps of the spiral cord is equalized.

3. The ligature of claim 2, wherein:

a first portion of the wraps of the spiral cord are wound in a first direction;

a second portion of the wraps of the spiral cord are wound in a second direction which is opposite to the first direction; and the first portion of the wraps of the spiral cord is joined to the second portion of the wraps of the spiral cord by a central portion of the spiral cord.

4. The ligature of claim 3, wherein:

the bearing surface of the bridge is adapted to grip the mouthpiece.

5. The ligature of claim 4, wherein:

the bearing surface of the bridge includes an insert to substantially vibrationally isolate the bridge from the mouthpiece and the reed.

6. The ligature of claim 5, further comprising:

means disposed along the wraps of the spiral cord between the bridge and the reed for keeping the wraps spaced apart and substantially perpendicular to the axis of the mouthpiece.

7. The ligature of claim 6, wherein:

the extension of the puller includes a threaded portion extending through the hole of the bridge; and the means for lifting the puller is a nut in threaded engagement with the threaded portion of the extension of the puller so that rotating the nut in one direction lifts the puller away from the mouthpiece.

8. The ligature of claim 7, wherein:

the first end of the spiral cord is fixably attached to one end of the puller and the second end of the spiral cord is fixably attached to the other end of the puller; and the holes of the puller are disposed along the puller between the one end of the puller and the other end of the puller.

9. The ligature of claim 1, wherein:

the extension of the puller includes a threaded portion extending through the hole of the bridge; and the means for lifting the puller is a nut in threaded engagement with the threaded portion of the extension of the puller so that rotating the nut in one direction lifts the puller away from the mouthpiece.

10. The ligature of claim 9, further comprising:

means disposed along the wraps of the spiral cord between the bridge and the reed for keeping the wraps spaced apart and substantially perpendicular to the axis of the mouthpiece.

11. The ligature of claim 10, wherein:

the spiral cord includes a first end fixably attached to the puller and a second end fixably attached to the puller; and the wraps of the spiral cord are free to move within the holes of the puller so that, as the reed is secured to the mouthpiece, the tension in the wraps of the spiral cord is equalized.

12. The ligature of claim 10, wherein:

a first portion of the wraps of the spiral cord are wound in a first direction;

a second portion of the wraps of the spiral cord are wound in a second direction which is opposite to the first direction; and the first portion of the wraps of the spiral cord is joined to the second portion of the wraps of the spiral cord by a central portion of the spiral cord.

13. The ligature of claim 12, wherein:

the bearing surface of the bridge is adapted to grip the mouthpiece.

14. The ligature of claim 13, wherein:

the bearing surface of the bridge includes an insert to substantially vibrationally isolate the bridge from the mouthpiece and the reed.

15. The ligature of claim 1, wherein:

the spiral cord includes an inner core made of a microfilament polymer and an outer layer made of polyester.

16. The ligature of claim 15, wherein:

the spiral cord includes a first end fixably attached to the puller and a second end fixably attached to the puller; and the wraps of the spiral cord are free to move within the holes of the puller so that, as the reed is secured to the mouthpiece, the tension in the wraps of the spiral cord is equalized.

17. The ligature of claim 16, wherein:

a first portion of the wraps of the spiral cord are wound in a first direction;

a second portion of the wraps of the spiral cord are wound in a second direction which is opposite to the first direction; and the first portion of the wraps of the spiral cord is joined to the second portion of the wraps of the spiral cord by a central portion of the spiral cord.

18. The ligature of claim 17, further comprising:

means disposed along the wraps of the spiral cord between the bridge and the reed for keeping the wraps spaced apart and substantially perpendicular to the axis of the mouthpiece.

* * * * *